US010681997B1

(12) United States Patent
Rigas

(10) Patent No.: US 10,681,997 B1
(45) Date of Patent: Jun. 16, 2020

(54) COUCH BLANKET

(71) Applicant: Peter Rigas, Yardley, PA (US)

(72) Inventor: Peter Rigas, Yardley, PA (US)

(73) Assignee: Tomzi International, Ltd, Yardley, PA (US)

( * ) Notice: Subject to any disclaimer, the term of this patent is extended or adjusted under 35 U.S.C. 154(b) by 0 days.

(21) Appl. No.: 16/299,175

(22) Filed: Mar. 12, 2019

Related U.S. Application Data

(60) Provisional application No. 62/716,373, filed on Aug. 9, 2018.

(51) Int. Cl.
*A47G 9/02* (2006.01)
*A47G 9/00* (2006.01)

(52) U.S. Cl.
CPC ..... *A47G 9/0223* (2013.01); *A47G 9/00* (2013.01); *A47G 9/02* (2013.01)

(58) Field of Classification Search
CPC ..... A47G 9/0223; A47G 9/02; A47G 9/0238; A47G 9/0207; A47G 9/08; A47G 9/04; A47G 9/023; A47G 9/00; A47C 31/10
See application file for complete search history.

(56) References Cited

U.S. PATENT DOCUMENTS 917,403 A * 4/1909 Benger ..... A47G 9/08 5/413 R
1,074,389 A * 9/1913 Sullivan ..... A41D 13/0015 2/69
1,315,294 A * 9/1919 Fink et al. ..... A47G 9/08 5/413 R
1,639,156 A * 8/1927 Wilmert ..... A47D 15/008 5/502
1,646,792 A * 10/1927 Ryals Moore ..... A47D 15/02 5/485
1,688,624 A * 10/1928 Kanter ..... A47G 9/0207 128/872
2,146,400 A * 2/1939 Maker ..... A47G 9/066 2/69
2,530,464 A * 11/1950 Haman ..... A41B 13/06 2/69.5
2,554,325 A * 5/1951 Comyns ..... A47C 21/08 128/872
D168,887 S * 2/1953 Friedman ..... D2/719
(Continued)

*Primary Examiner* — Nicholas F Polito
*Assistant Examiner* — Morgan J McClure
(74) *Attorney, Agent, or Firm* — Joseph E. Maenner; Maenner & Associates, LLC

(57) ABSTRACT

A couch blanket includes a rear edge having first and second corners, wherein a first connector strap assembly extends from the first and a second connector strap assembly extends from the second corner. A left edge extends from the rear edge proximate to the first connector strap assembly and has a left length. A right edge extending from the rear edge proximate to the second connector strap assembly and has a right length. A front edge connects the left edge and the right edge, distal from the rear edge. A first plurality of connectors extends along each of the left edge. The first plurality of connectors has a first left connector portion and a plurality of second left connector portions, such that the first left connector portion is configured to engage one of the second left connector portions such that, when the first left connector portion is engaged with one of the second left connector portions, the left length is shortened.

13 Claims, 15 Drawing Sheets

(56) References Cited

U.S. PATENT DOCUMENTS 2,659,086 A * 11/1953 McGrath ..... A41D 3/00 2/88
2,701,885 A * 2/1955 Turco ..... A47G 9/04 5/494
2,712,133 A * 7/1955 Coleman ..... A61G 5/10 2/69
2,716,239 A * 8/1955 Barndollar ..... A41B 13/06 2/69.5
2,832,967 A * 5/1958 Sobel ..... A47G 9/0207 5/498
2,911,648 A * 11/1959 Schanda-Seyferth ..... A41D 15/04 2/69
3,034,132 A * 5/1962 Landsberger ..... A41B 13/06 2/69.5
3,083,378 A * 4/1963 Pursell ..... A47C 21/022 5/498
3,179,958 A * 4/1965 Carris ..... A47G 9/0238 5/496
3,331,088 A * 7/1967 Marquette ..... A47G 9/023 5/502
3,355,748 A * 12/1967 Tuvert ..... A47G 9/02 5/502
3,381,306 A * 5/1968 Innes ..... A41D 15/00 2/69
3,597,764 A * 8/1971 Povey ..... A41D 15/04 2/69.5
3,857,124 A * 12/1974 Hadley ..... A47C 21/022 5/496
4,215,435 A * 8/1980 Miele ..... A41D 15/002 2/227
D270,400 S * 9/1983 Schutz ..... D12/129
4,573,227 A * 3/1986 Prandina ..... A47G 9/0207 5/486
4,575,876 A * 3/1986 Weaver ..... A47G 9/086 2/69.5
4,924,543 A * 5/1990 Hoss ..... A47G 9/02 5/421
4,932,077 A * 6/1990 Dobbs ..... A61G 5/10 2/47
4,998,296 A * 3/1991 Stames ..... A41D 13/02 2/458
5,283,909 A * 2/1994 Hill ..... A47G 9/066 2/22
5,549,355 A 8/1996 Illulian
5,560,043 A * 10/1996 Armstrong ..... A41D 3/00 2/69.5
5,611,082 A * 3/1997 Bull ..... A41D 13/00 2/79
5,611,095 A * 3/1997 Schneider ..... A41B 13/06 2/69
5,732,424 A * 3/1998 Bond ..... A47G 9/02 5/498
5,956,766 A * 9/1999 Benway ..... B62B 9/10 2/69
5,970,542 A * 10/1999 Mays ..... A47G 9/066 2/69.5
6,055,686 A * 5/2000 Knight ..... A47G 9/068 2/69.5
6,079,778 A 6/2000 Lindberg
D430,079 S * 8/2000 Catron-Batts ..... D12/133
6,116,685 A 9/2000 White et al.
6,134,730 A * 10/2000 Evanson ..... A47G 9/02 5/482
6,219,847 B1 * 4/2001 Aikins ..... A41D 15/04 2/69
6,485,099 B2 11/2002 Illulian
6,568,007 B1 * 5/2003 Hatcher ..... A47G 9/0223 112/475.08
6,643,870 B2 * 11/2003 Bertrand ..... A47G 9/066 2/69
6,859,960 B1 * 3/2005 Jerome ..... A47G 9/083 5/413 R
7,003,825 B1 * 2/2006 Levings ..... A47G 9/066 2/69.5
7,581,259 B2 * 9/2009 Thompson ..... A47G 9/066 2/69.5
7,637,567 B2 12/2009 Neustal et al.
7,647,656 B2 * 1/2010 Smith ..... A41D 15/04 5/413 AM
7,752,690 B1 * 7/2010 Seth ..... A47G 9/086 2/69.5
D623,381 S * 9/2010 Flannery ..... D2/728
8,104,119 B2 1/2012 Truex
D684,797 S * 6/2013 Rohwer ..... D6/603
8,464,374 B1 * 6/2013 Thayer ..... A47G 9/08 2/69
8,904,580 B1 * 12/2014 Christensen ..... A47G 9/083 2/69.5
D737,023 S * 8/2015 Tolbert ..... D2/719
D751,270 S * 3/2016 White ..... D2/719
9,386,814 B2 * 7/2016 Flora ..... A41D 15/04
9,756,882 B2 * 9/2017 Townsend ..... A41D 13/0012
9,788,671 B1 * 10/2017 Wuerz ..... A47G 9/0223
9,968,205 B1 * 5/2018 Gaudyn ..... A47D 15/008
D855,355 S * 8/2019 McClellan-Miller ..... D6/603
2004/0088789 A1 5/2004 Mitchell
2006/0021140 A1 * 2/2006 Cha ..... A47G 9/0207 5/482
2006/0117455 A1 * 6/2006 Park ..... A41D 3/08 2/69.5
2006/0174409 A1 * 8/2006 Hermanson ..... A47G 9/0223 5/482
2007/0007800 A1 * 1/2007 Thompson ..... A47G 9/066 297/184.1
2007/0067909 A1 * 3/2007 Lampkins ..... A47G 9/02 5/482
2008/0010746 A1 * 1/2008 Ho ..... A47G 9/0238 5/482
2008/0060132 A1 * 3/2008 Bradford ..... A47C 31/11 5/501
2008/0313809 A1 * 12/2008 Inman, II ..... A47G 9/0207 5/486
2009/0151072 A1 * 6/2009 Jones, III ..... A47G 9/02 5/486
2009/0199336 A1 * 8/2009 Gentile ..... A47G 9/0223 5/486
2009/0294075 A1 * 12/2009 Huck ..... A63H 33/008 160/127
2010/0107336 A1 * 5/2010 Ross ..... A47C 31/10 5/490
2010/0199402 A1 * 8/2010 Curtis ..... A47G 9/064 2/69
2010/0263104 A1 * 10/2010 Flannery ..... A47G 9/066 2/69
2013/0117933 A1 * 5/2013 Mickle ..... A47G 9/02 5/413 R
2013/0174316 A1 * 7/2013 Smallman ..... A47D 15/008 2/69.5
2013/0180050 A1 * 7/2013 Koci ..... A47G 9/02 5/496
2013/0305450 A1 * 11/2013 Douglas ..... A47G 9/0223 5/484
2013/0326810 A1 * 12/2013 Davidson ..... A47G 9/066 5/413 R
2014/0265483 A1 9/2014 Miller
2014/0318586 A1 10/2014 Watson
2016/0192792 A1 * 7/2016 Townsend ..... A41D 13/0012 5/484
2017/0156509 A1 6/2017 Markowitz
2018/0184819 A1 * 7/2018 Gaudyn ..... A47G 9/02
2018/0242762 A1 8/2018 Distefano et al.
2018/0360241 A1 * 12/2018 McClellan-Miller ..... A47G 9/066
2019/0208936 A1 * 7/2019 Thomas ..... A47G 9/1045

* cited by examiner

COUCH BLANKET

CROSS-REFERENCE TO RELATED APPLICATION

The present application claims the benefit of U.S. Provisional Patent Application Ser. No. 62/716,373, filed on Aug. 9, 2018, which is incorporated herein by reference in its entirety.

BACKGROUND OF THE INVENTION

Field of the Invention

The present invention relates to blankets that can be stowed on the back surface of a couch or sofa (hereinafter, collectively, "couch") and pulled out to allow a person sitting or lying on the couch to pull the blanket over themselves.

Background if the Invention

Often, persons will drape a blanket over the back of their couch so that, when they are sitting or lying on the couch and get cold, they can readily pull the blanket from the back of the couch and drape it over themselves.

A drawback, however, is that the blanket can fall, particularly if the user is lying or sleeping on the couch and rolls over. It would be beneficial to provide a blanket that can be used on a couch that does not fall off the back of the couch, and can be used by users who are lying down or are sitting on the couch.

BRIEF SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

In one embodiment, the present invention is a couch blanket that includes a rear edge having first and second corners, wherein a first connector strap assembly extends from the first and a second connector strap assembly extends from the second corner. A left edge extends from the rear edge proximate to the first connector strap assembly and has a left length. A right edge extending from the rear edge proximate to the second connector strap assembly and has a right length. A front edge connects the left edge and the right edge, distal from the rear edge. A first plurality of connectors extends along each of the left edge. The first plurality of connectors has a first left connector portion and a plurality of second left connector portions, such that the first left connector portion is configured to engage one of the second left connector portions such that, when the first left connector portion is engaged with one of the second left connector portions, the left and right lengths are shortened.

In an alternative embodiment, a couch blanket comprises a body having a rear edge, a front edge, a left edge extending between the rear edge and the front edge, and a right edge, distal from the left edge, the right edge extending between the rear edge and the front edge. A first plurality of connectors extends along the left edge. The first plurality of connectors has a first left connector portion and a plurality of second left connector portions, such that the first left connector portion is configured to engage one of the second left connector portions. When the first left connector portion is engaged with one of the second left connector portions, a distance between the front edge and the rear edge is shortened. A second plurality of connectors extends along the right edge. The second plurality of connectors has a first right connector portion and a plurality of second right connector portions. The first right connector portion is configured to engage one of the second right connector portions such that, when the first right connector portion is engaged with one of the second right connector portions, a distance between the front edge and the rear edge is shortened.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION

Figure 1:
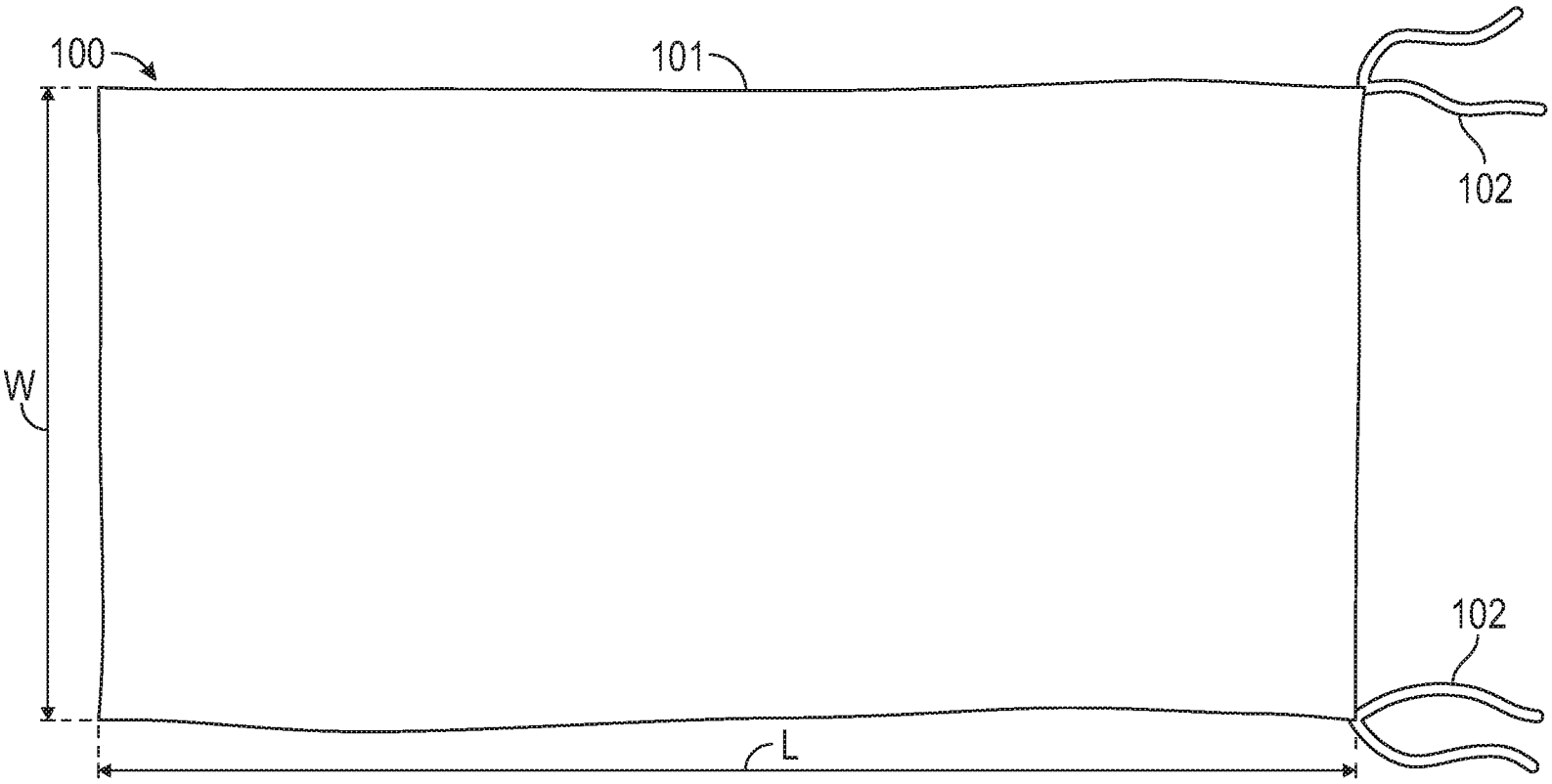
FIG. 1 is a front elevational view of a couch blanket according to an exemplary embodiment of the present invention.

In the drawings, like numerals indicate like elements throughout. Certain terminology is used herein for convenience only and is not to be taken as a limitation on the present invention. The terminology includes the words specifically mentioned, derivatives thereof and words of similar import. The embodiments illustrated below are not intended to be exhaustive or to limit the invention to the precise form disclosed. These embodiments are chosen and described to best explain the principle of the invention and its application and practical use and to enable others skilled in the art to best utilize the invention.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

As used in this application, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

Additionally, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Unless explicitly stated otherwise, each numerical value and range should be interpreted as being approximate as if the word "about" or "approximately" preceded the value of the value or range.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

Figure 5:
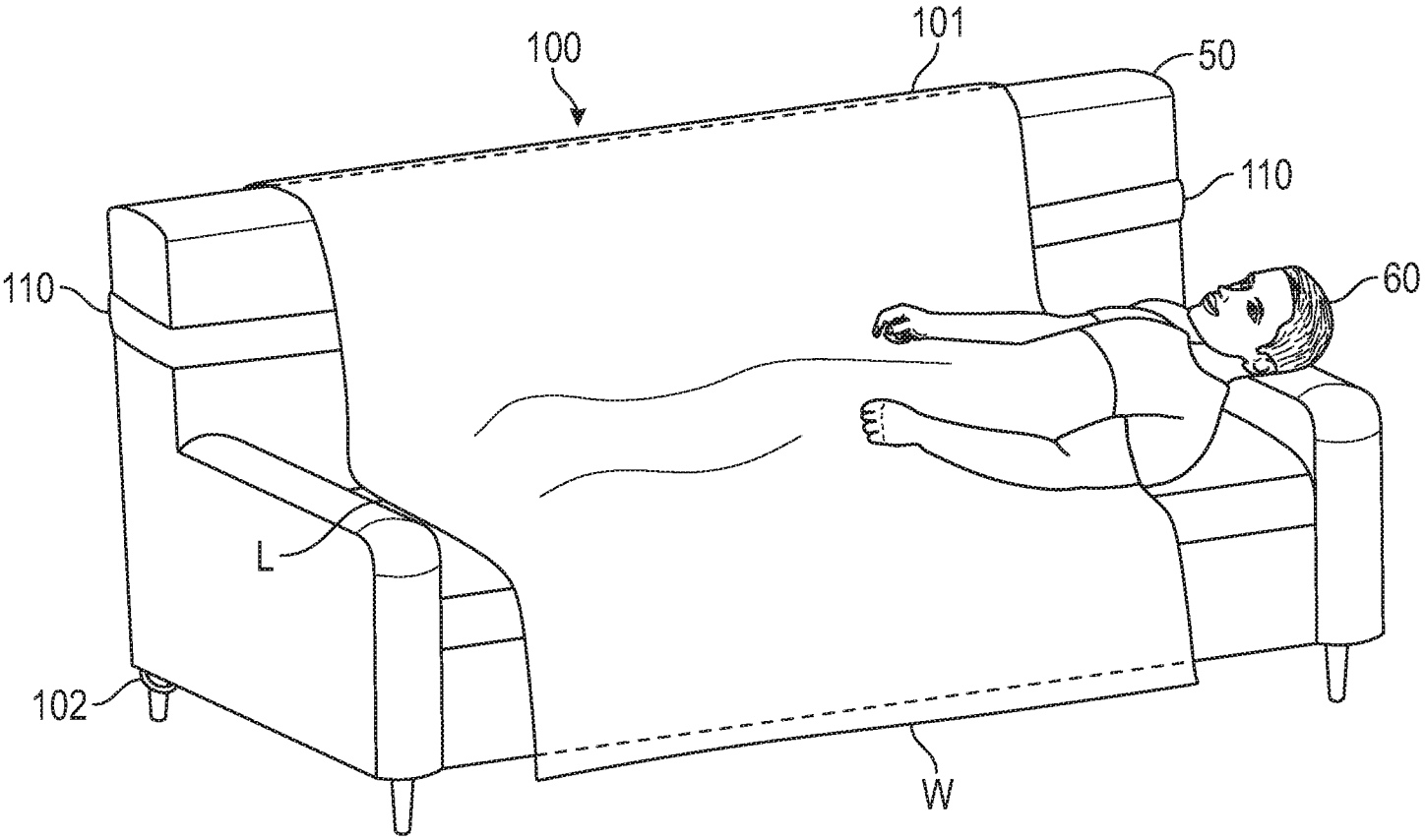
FIG. 5 is a perspective view of the couch blanket of FIG. 1 used by a user on a couch.

Referring to the Figures, a couch blanket according to the present invention can be draped over the back of a couch 50 (shown in FIG. 5

Each blanket described herein includes a fabric material made from woven or non-woven flexible material, such as cotton, wool, rayon, or other suitable material. The fabric material is generally rectangular in shape, with a length "L" and a width "W". In an exemplary embodiment, for a standard couch 50, length L can be about 116 inches and width W can be about 84 inches, although those skilled in the art will recognize that length L and width W can be other dimensions, so that blanket 100 can be used for other sized furniture, such as love seats, sectional sofas, or other appropriate furniture.

Referring now to FIGS. 1-5, a blanket 100 according to an exemplary embodiment of the present invention is shown. Blanket 100 can be removably fixed to a couch 50 (shown in FIGS. 4 and 5) on a semi-permanent basis and used as a cover for the couch 50. When desired, blanket 50 can be pulled over a user 60 who is laying on couch 50 (shown in FIG. 5).

Ties 102 are connected to and extend from two adjacent sides of fabric 101. Ties 102 are separated by width W of fabric 101. Ties 102 are used to releasably secure blanket 100 to couch 50, such as to the rear legs 52 of couch 50 (shown in FIG. 4).

Figure 1A:
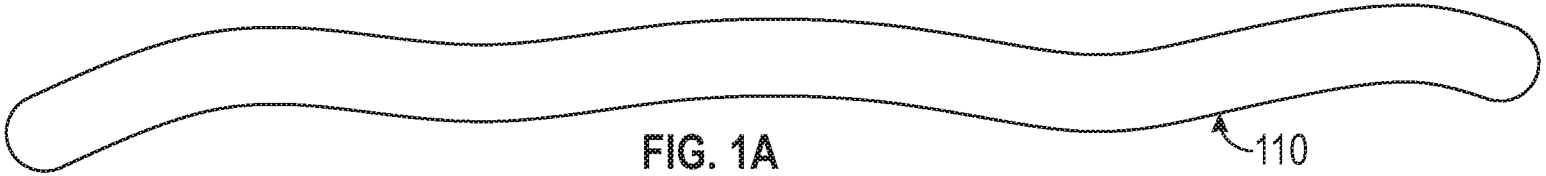
FIG. 1A is a side elevational view of a wrap strip for use with the couch blanket of FIG. 1.
Figure 2:
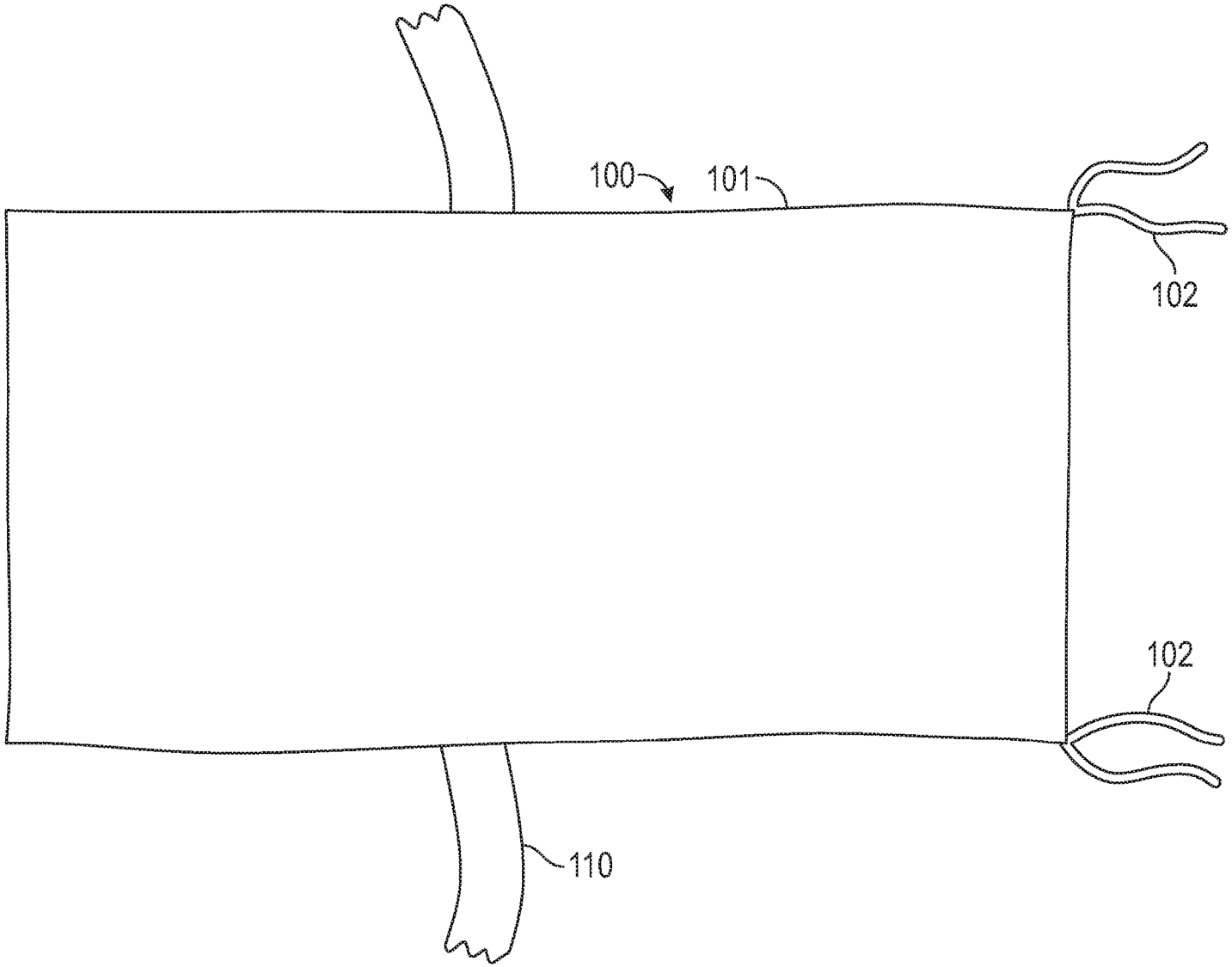
FIG. 2 is a side elevational view of an alternative exemplary embodiment of the present invention, with the wrap strip of FIG. 1A attached to the blanket of FIG. 1.
Figure 4:
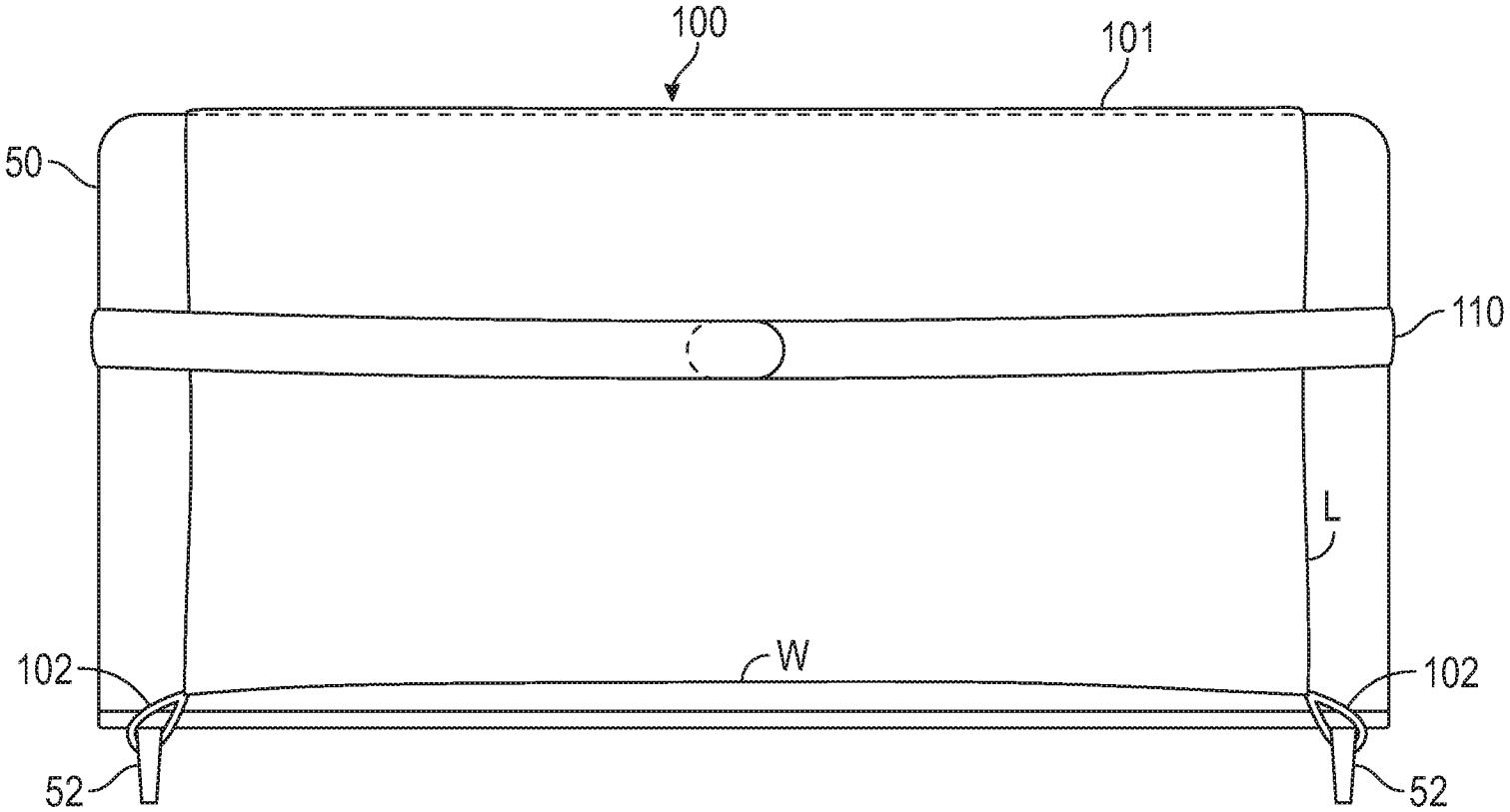
FIG. 4 is a rear elevational view of the couch blanket of FIG. 1 wrapped around a couch.

A wrap strip 110, shown in FIG. 1A, can be used to secure fabric 101 around a length of couch 50, as shown in FIGS. 4 and 5. As shown in FIG. 1, A, wrap strip 110 is separate from fabric 101, but alternatively, as shown in FIG. 2, wrap strip 110 can be fixedly attached to fabric 101. Ends of wrap strip 110 can be releasably connected to each other, such s by hook and loop fasteners, tying the ends together, snap, buttons, or other known securing devices.

Figure 3A:
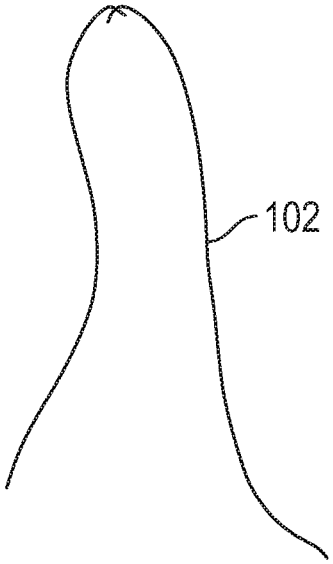
FIG. 3A is a first exemplary embodiment of a tie that is used with the couch blanket of FIG. 1.
Figure 3B:
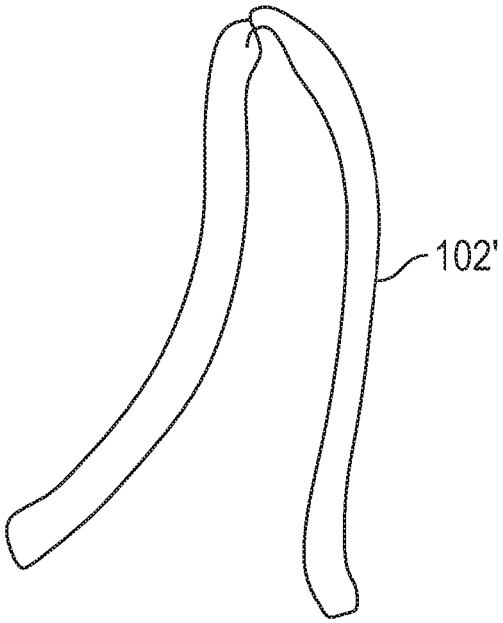
FIG. 3B is a second exemplary embodiment of a tie that is used with the couch blanket of FIG. 1.
Figure 3C:
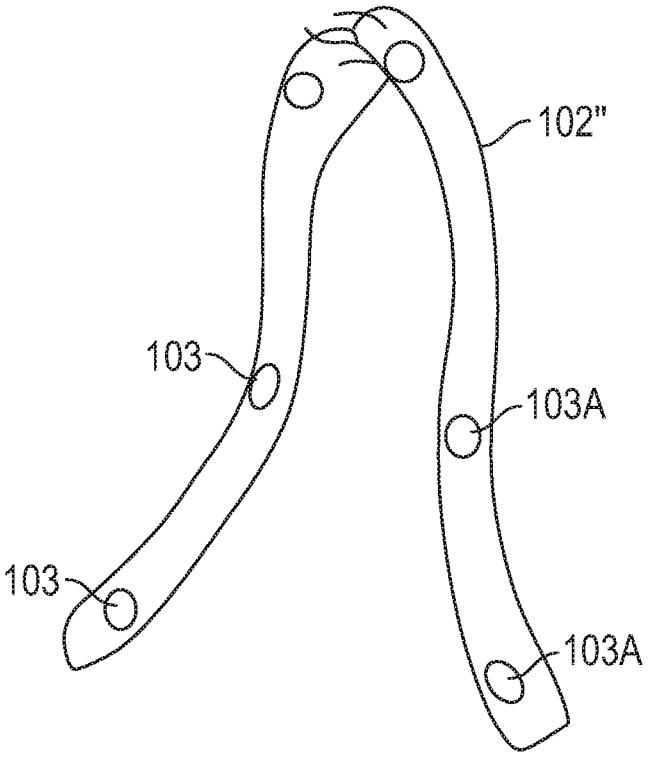
FIG. 3C is a third exemplary embodiment of a tie that is used with the couch blanket of FIG. 1.

FIGS. 3A-3C show different embodiments of ties that can be used. FIG. 3A shows tie 102 that can simply be a length of fabric that is tied together around leg 52 of couch 50. FIG. 3B shows toe 102' that is a hook and loop fastener, with one end of tie 102' having hooks and the other end of tie 102' having loops. FIG. 3C shows tie 102" having snaps or buttons 103 that are located along the length of one side of tie 102", with corresponding snap connectors or button holes 103A along the length of the remaining side of tie 102".

Blanket 100 is draped over couch 50 as shown in FIGS. 4 and 5, with ties 102 tied to each of rear legs 52 of couch 50 and wrap strip 110 wrapped around the length of couch 50 and secured to itself along the rear of couch 50 (FIG. 4), with fabric 101 being sandwiched between wrap strip 110 and the rear of couch 50.

FIG. 5 shows fabric 101 draped over the front of couch 50, with a user 60 lying on couch 50 underneath blanket 100. When not in use, fabric 101 can be lifted and dropped over the rear of couch 50 so that fabric 101 is not seen, leaving only wrap strip 110 visible across the front of couch. Alternatively, fabric 101 can remain draped over the front of couch so that user 60 can sit on couch 50 on top of fabric 101.

Figure 6:
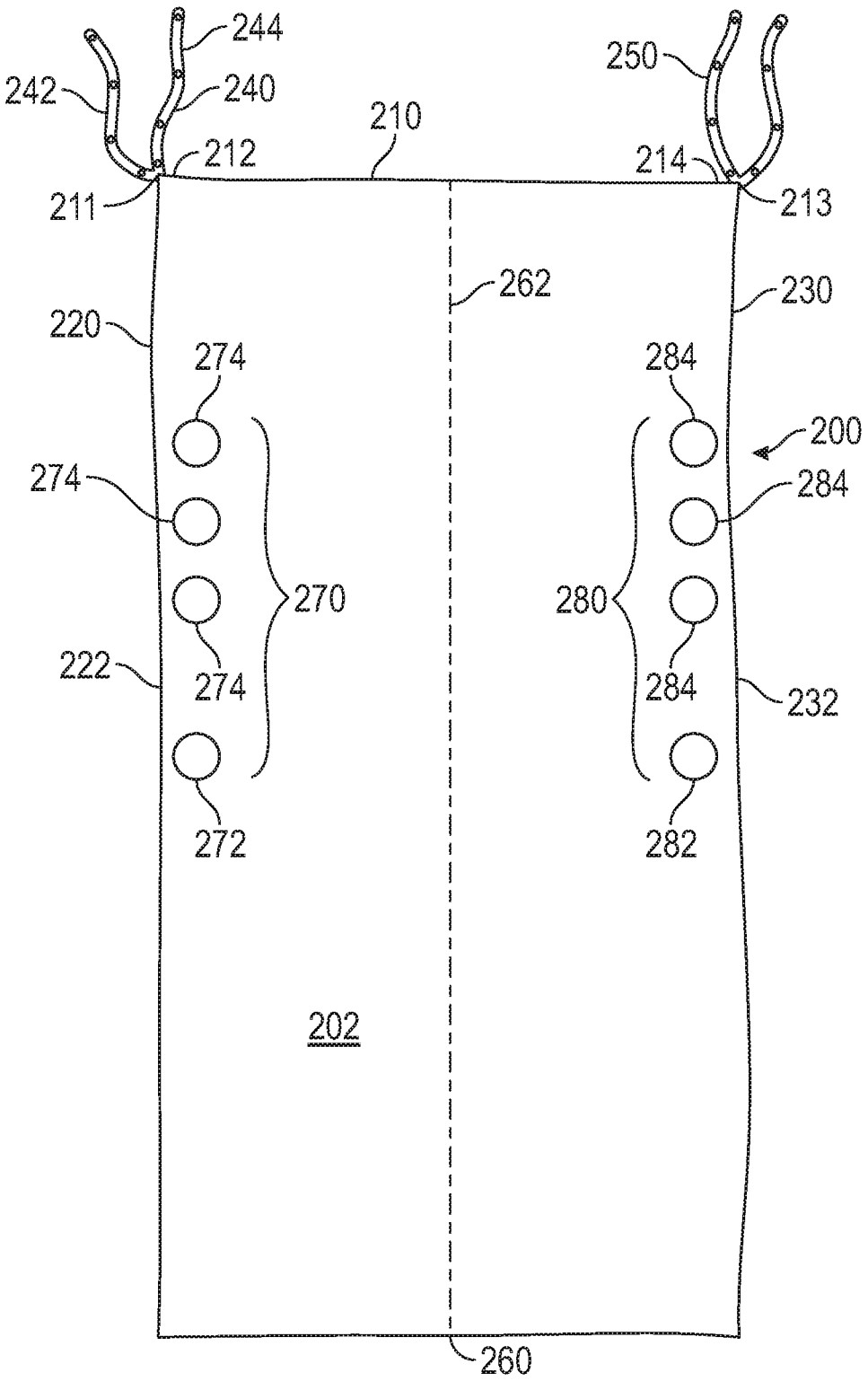
FIG. 6 is a front elevational view of an alternative embodiment of a blanket according to the present invention.

An alternative embodiment of a blanket 200 according to the present invention is shown in FIG. 6. Blanket 200 includes a generally rectangular body 202, although those skilled in the art will recognize that body 202 can be other shapes. Body 202 can be constructed from a sheet of material, such as a woven fabric. The fabric can be cotton, wool, polyester, natural or synthetic fibers, or any combination of fibrous material.

Body 202 includes a rear edge 210 that runs along the length of body 202 between a first corner 212 and a second corner 214.

A left edge 220 extends from an intersection 211 with rear edge 210 in a generally orthogonal direction from first corner 212. Left edge 220 has a left length 222.

Similarly, a right edge 230, distal from left edge 220, extends from an intersection 213 with rear edge 210 in a generally orthogonal direction from second corner 214. Right edge 220 has a right length 222.

A first connector strap assembly 240 extends from first corner 212 proximate to left edge 220 and intersection 211 between rear edge 210 and left edge 220. A second connector strap assembly 250 extends from second corner 214 proximate to right edge 230 and an intersection between rear edge 210 and right edge 230.

Figure 7:
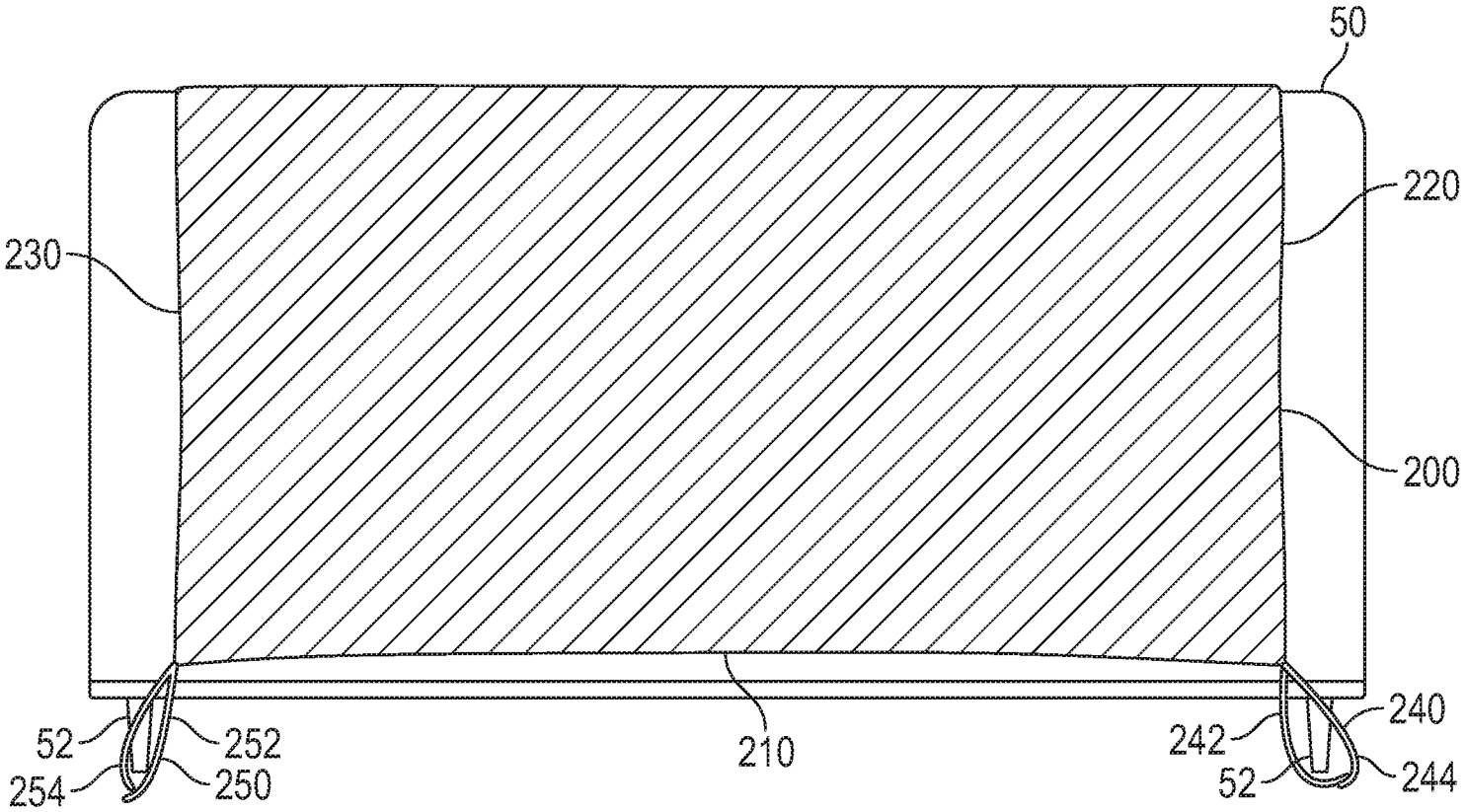
FIG. 7 is a rear elevational view of the blanket of FIG. 6 secured to rear couch legs.

Connector strap assembly 240 can include first and second straps 242, 244 that can be tied around the rear leg 52 of couch 50 (as shown in FIG. 7). Straps 242, 244 can include complementary connecting members, such as, for example, hook and loop fasteners, snaps, buttons and button holes, or other known securing mechanisms.

Referring back to FIG. 6, a front edge 260 connects left edge 220 and right edge 230, distal from rear edge 210, such that left edge 220 extends between rear edge 210 and front edge 260 and right edge 230 extends between rear edge 210 and the front edge 260.

A central longitudinal axis 262 extends from rear edge 210 to front edge 260 between left edge 220 and right edge 230.

A first plurality of connectors 270 extends along left edge 220. First plurality of connectors 270 has a first left connector portion 272 and a plurality of second left connector portions 274, such that first left connector portion 272 is configured to engage one of second left connector portions 274 such that, when first left connector portion 272 is engaged with one of second left connector portions 274, left length 222 is shortened.

Similarly, a second plurality of connectors 280 extends along right edge 230 Second plurality of connectors 280 has a first right connector portion 282 and a plurality of second right connector portions 284, such that first right connector portion 282 is configured to engage one of second right connector portions 284 such that, when first right connector portion 282 is engaged with one of second right connector portions 284, the right length 232 is shortened.

Connectors 270, 280 can be known connectors, such as, for example, hook and loop fasteners, buttons and button holes, snaps, or other suitable connector pairs. Connectors 270, 280, in conjunction with strap assemblies 240, 250, provide for two adjustment zones for blanket 200 on couch 50 as well as how blanket 200 sits over user 60. Connectors 270, 280 and strap assemblies can be adjusted to accommodate the thickness of the backrest of couch 50.

Figure 8:
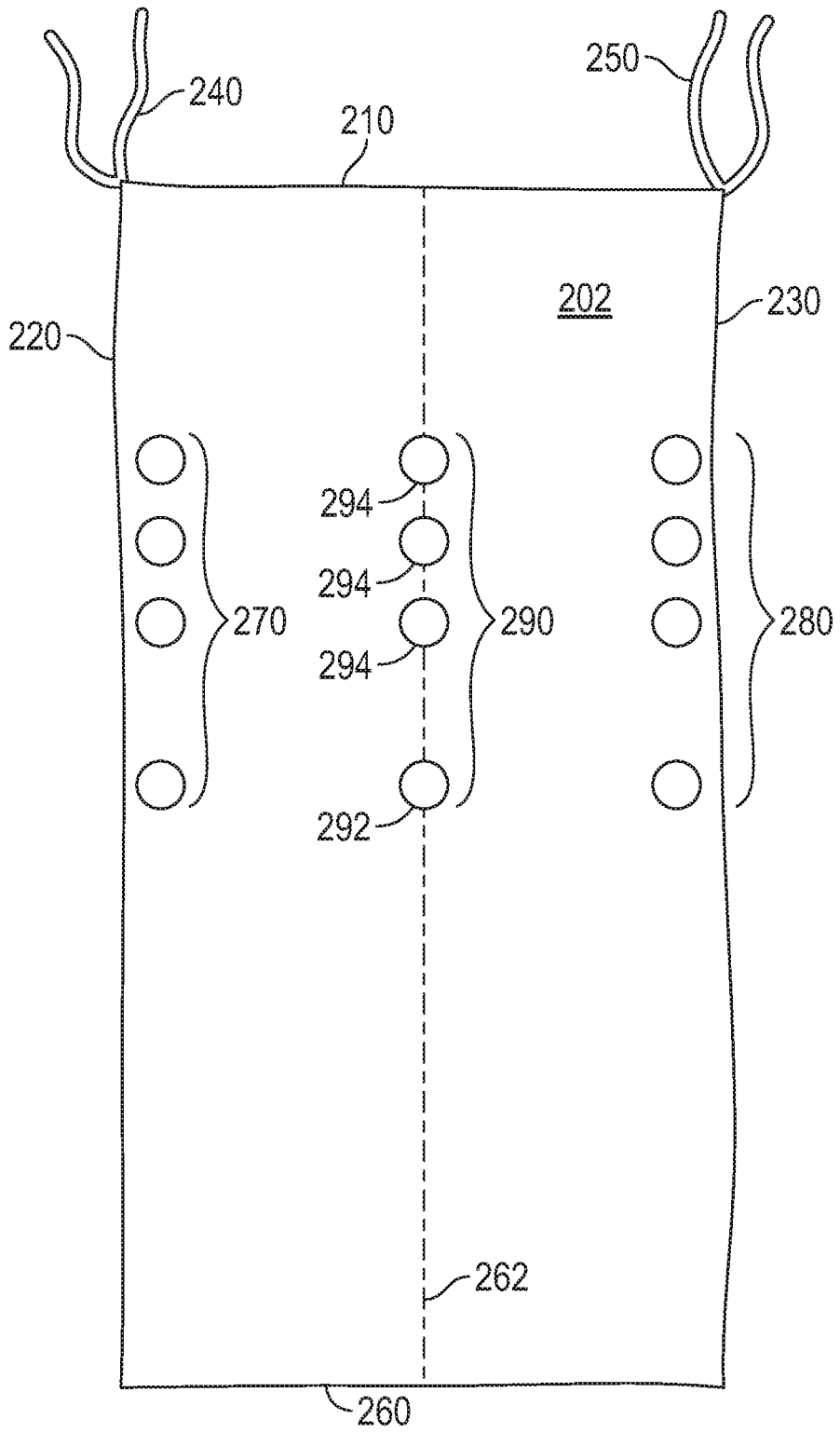
FIG. 8 is a front elevational view of an alternative embodiment of a blanket according to the present invention.

Optionally, as shown in FIG. 8, an additional third plurality of connectors 290 can extend along central longitudinal axis 262. Third plurality of connectors 290 includes a first middle connector portion 292 and a plurality of second middle connector portions 294, such that first middle connector portion 292 is configured to engage one of second middle connector portions 294. Third plurality of connectors 290 can be especially useful if blanket 200 is relatively long between left edge 220 and right edge 230, to support body 202 mid way between left edge 220 and right edge 230 and prevent the middle of blanket 200 from collapsing under its own weight.

Figure 9:
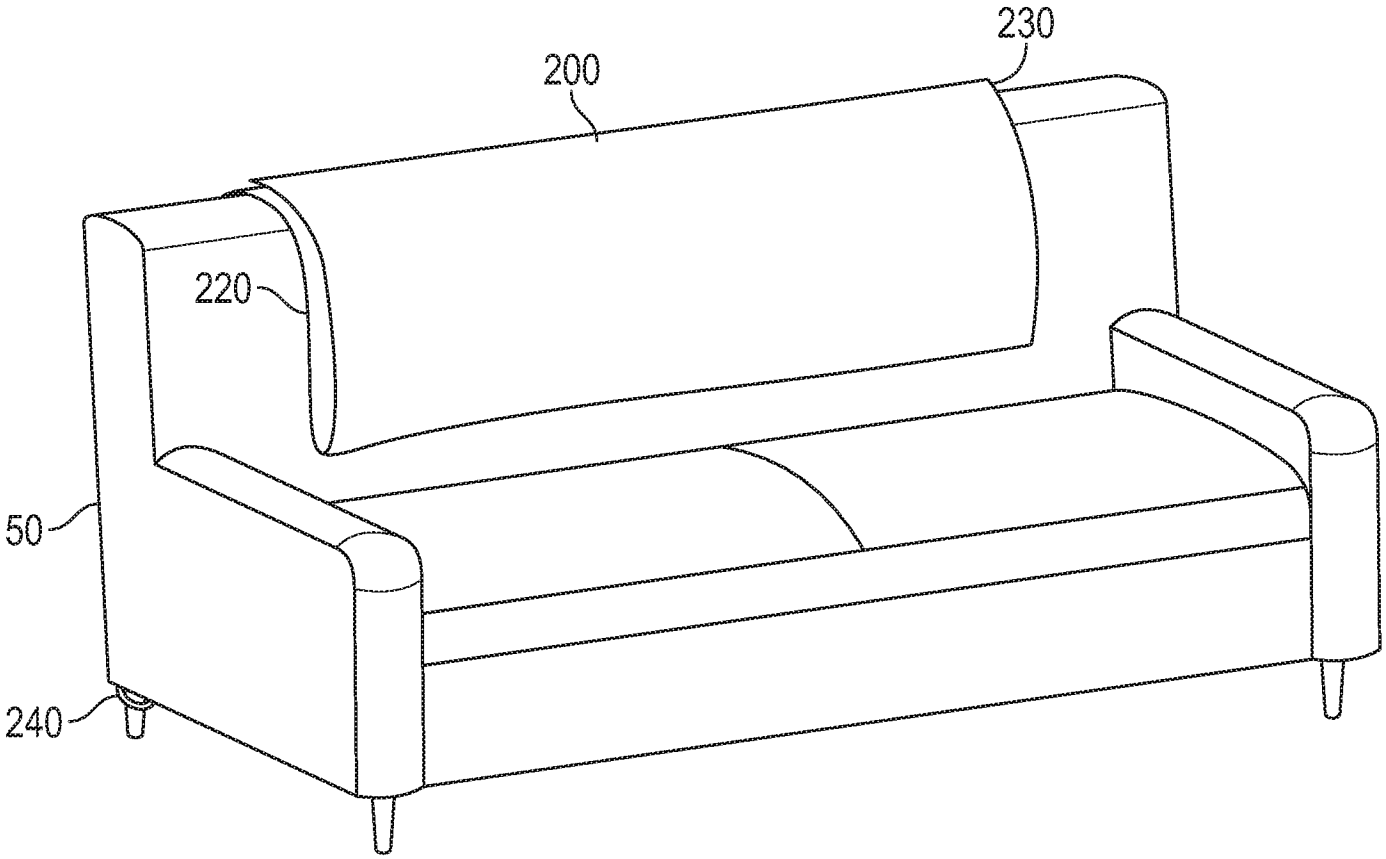
FIG. 9 is a perspective view of the blanket of FIG. 6 draped over the front of the couch of FIG. 7.
Figure 10:
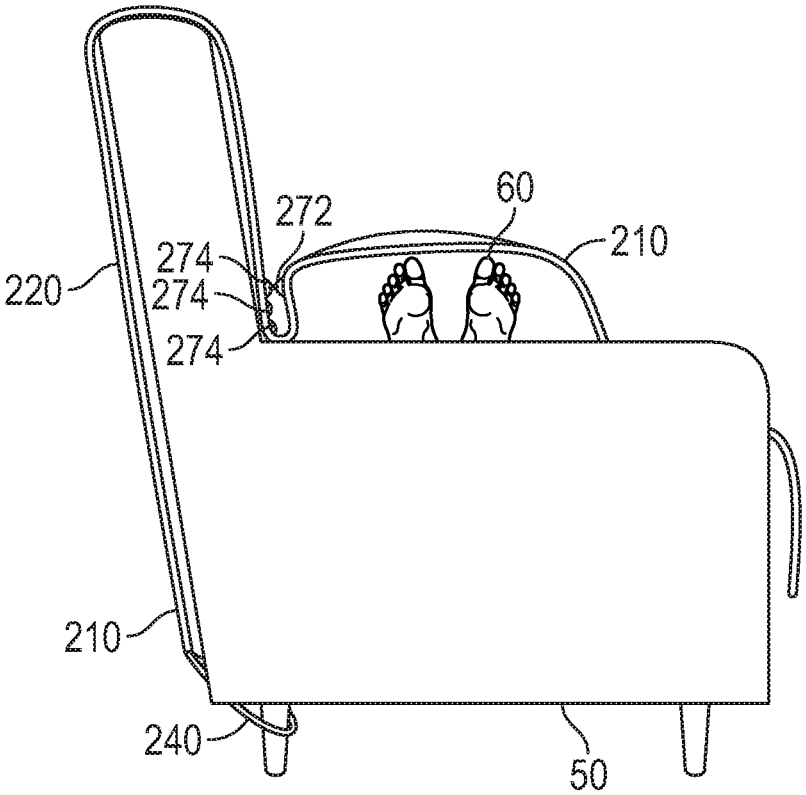
FIG. 10 is a side elevational view of the blanket of FIG. 6 in use over a user lying on the couch of FIG. 7.
Figure 11:
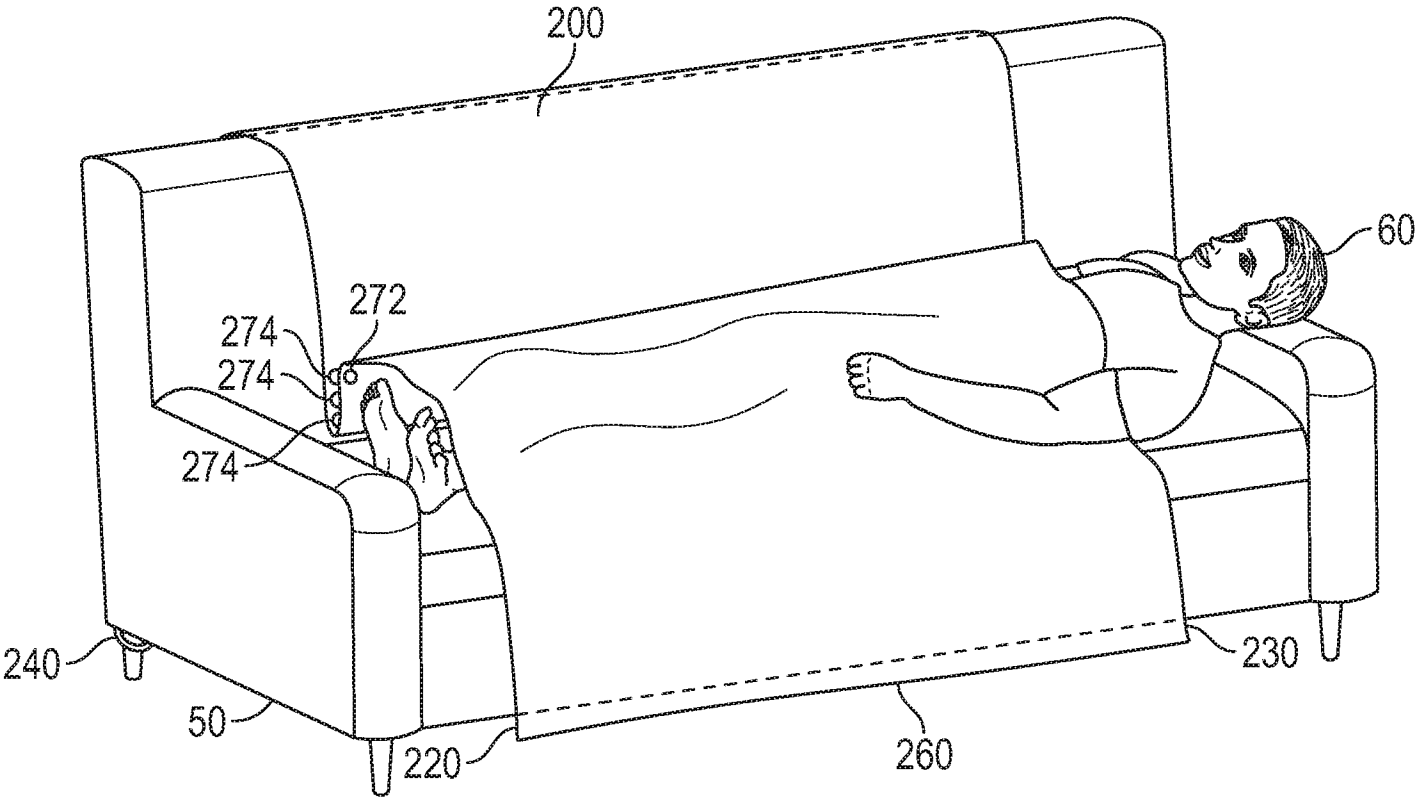
FIG. 11 is a perspective view of the blanket of FIG. 6 in use over the user lying on the couch of FIG. 10.

When not in use, blanket 200 can be draped over a couch as shown in FIG. 9 so that front edge (not shown) hangs over behind couch 50. When a user 60 wants to use blanket 200 as a covering while lying on couch 50, the user 60 can pull front edge 260 over toward the front of couch 50. FIGS. 10 and 11 show how the user 60 can attach first left connector portion 272 with a selected on of second left connector portions 274, thereby shortening the length of left edge 220 (similarly for right edge 230 and right connector 280, shortening the length of right edge 230). The result is to prevent "tenting" of blanket 200 over the user 60. Tenting is the effect of the blanket extending from the top of couch 50 over the user 60, without blanket 200 actually resting on top of the user 60.

Figure 12:
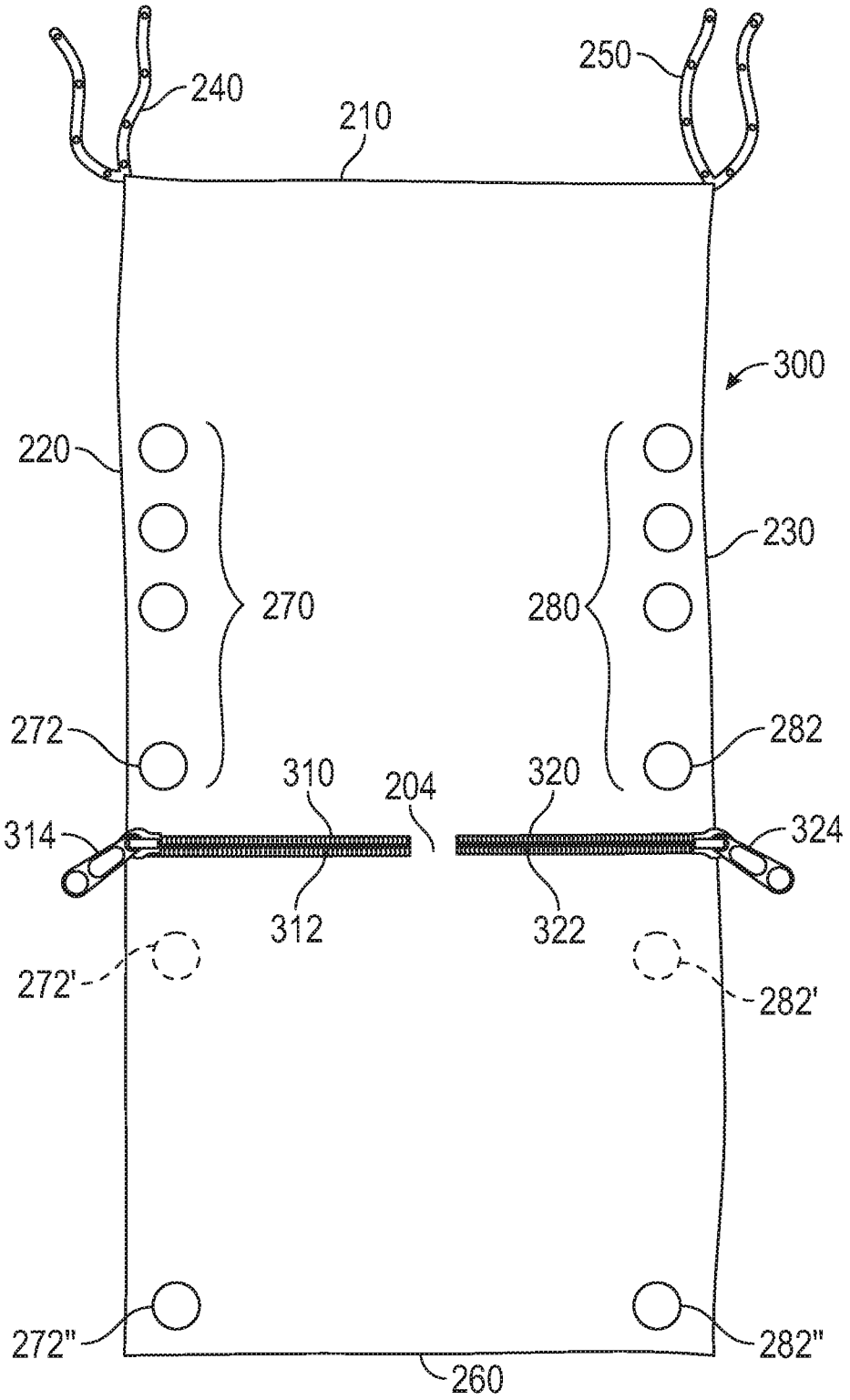
FIG. 12 is a front elevational view of an alternative embodiment of a blanket according to the present invention.

An alternative embodiment of a couch blanket 300 according to the present invention is shown in FIG. 12. Blanket 300 is similar to blanket 200 as shown in FIG. 6, but also includes a left slit 310 extending from left edge 220 toward right edge 230. Similarly, a right slit 320 extends from the right edge 230 toward left edge 220 such that left slit 310 and right slit 320 extend co-linearly.

Left slit 310 extends below first plurality of connectors 270 and right slit 320 extends below second plurality of connectors. As shown in FIG. 12, a portion of body 204 extends between left slit 310 and right slit 320 so that slits 310, 320 are separated from each other.

Additionally, another first left connector portion 272' is provided between left slit 310 and front edge 260. The other first left connector portion 272' is just below left slit 310 and is located on the underside of blanket 200. Similarly, another first right connector portion 282' is provided between right slit 320 and front edge 260. The other first right connector portion 282' is just below right slit 320 and is also located on the underside of blanket 300.

FIG. 12 also shows optional zippers 312, 322 that can be selectively opened/closed for the comfort and warmth of the user 60. In the closed position, as shown in FIG. 12, zipper pulls 314, 324 are at their respective left edge 220 and right edge 230 such that, to open zippers 312, 322, zipper pulls 314, 324 are pulled inward toward the middle of blanket 300.

While two separate zippers 312, 322 are shown, those skilled in the art will recognize that a single zipper (not shown) can extend fully between left edge 220 and right edge 230 of blanket 300.

Figure 13:
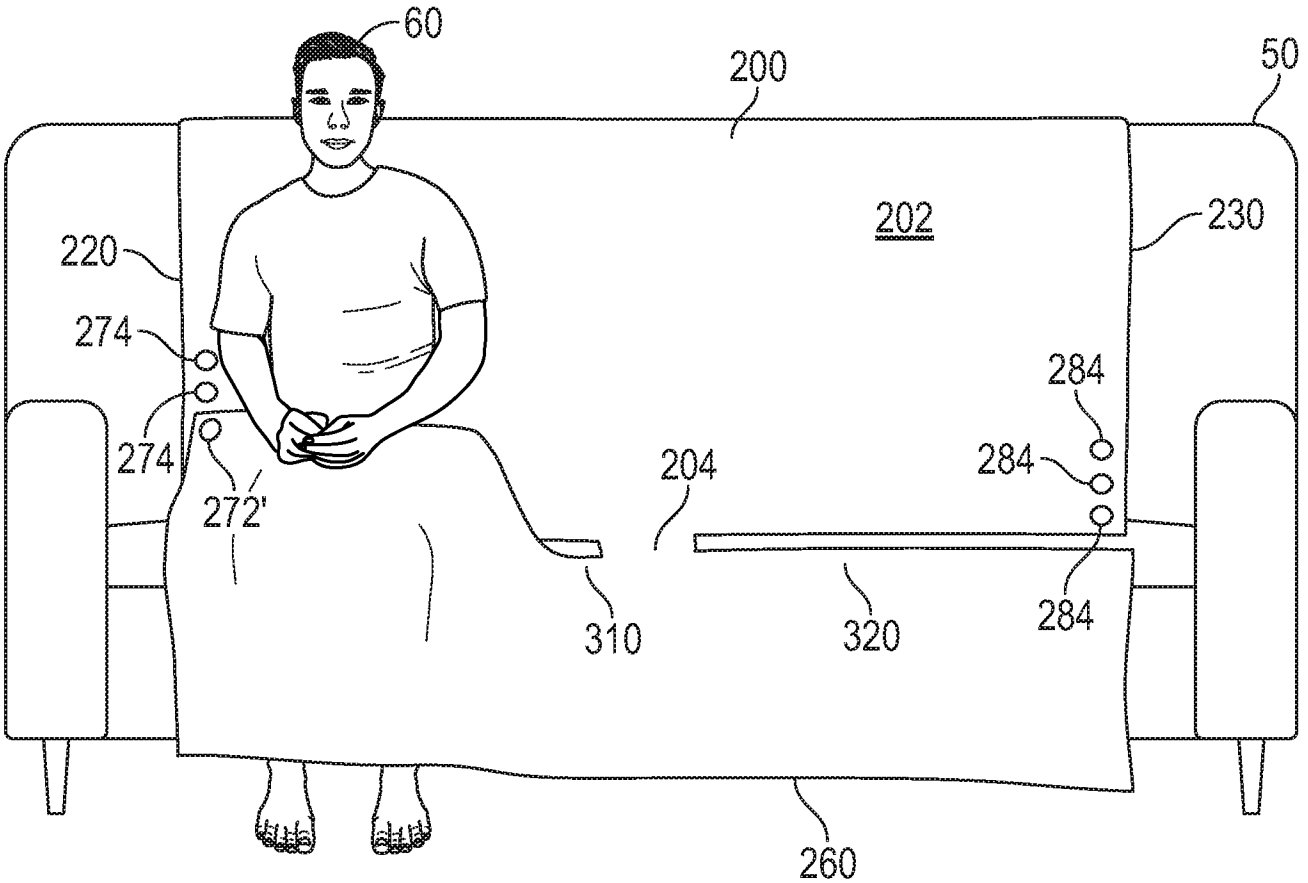
FIG. 13 is a front elevational view of the blanket of FIG. 12 with a user sitting on the couch.

As shown in FIG. 13, user 60 can use blanket 300 while sitting on couch 50 instead of lying on couch 50 to cover the legs and torso of user 60. User 60 can lift blanket 200 below left slit 310 and sit on couch 50, connecting the other first left connector portion 272' to one of the second left connector portions 274 so that blanket 200 is secured around the front of user 60. Similarly, although not shown, another user can sit on the right side of couch 50 and can lift blanket 200 below right slit 320 and sit on couch 50, connecting the other first right connector portion 282' to one of the second right connector portions 284 so that blanket 200 is secured around the front of user 60.

Figure 14:
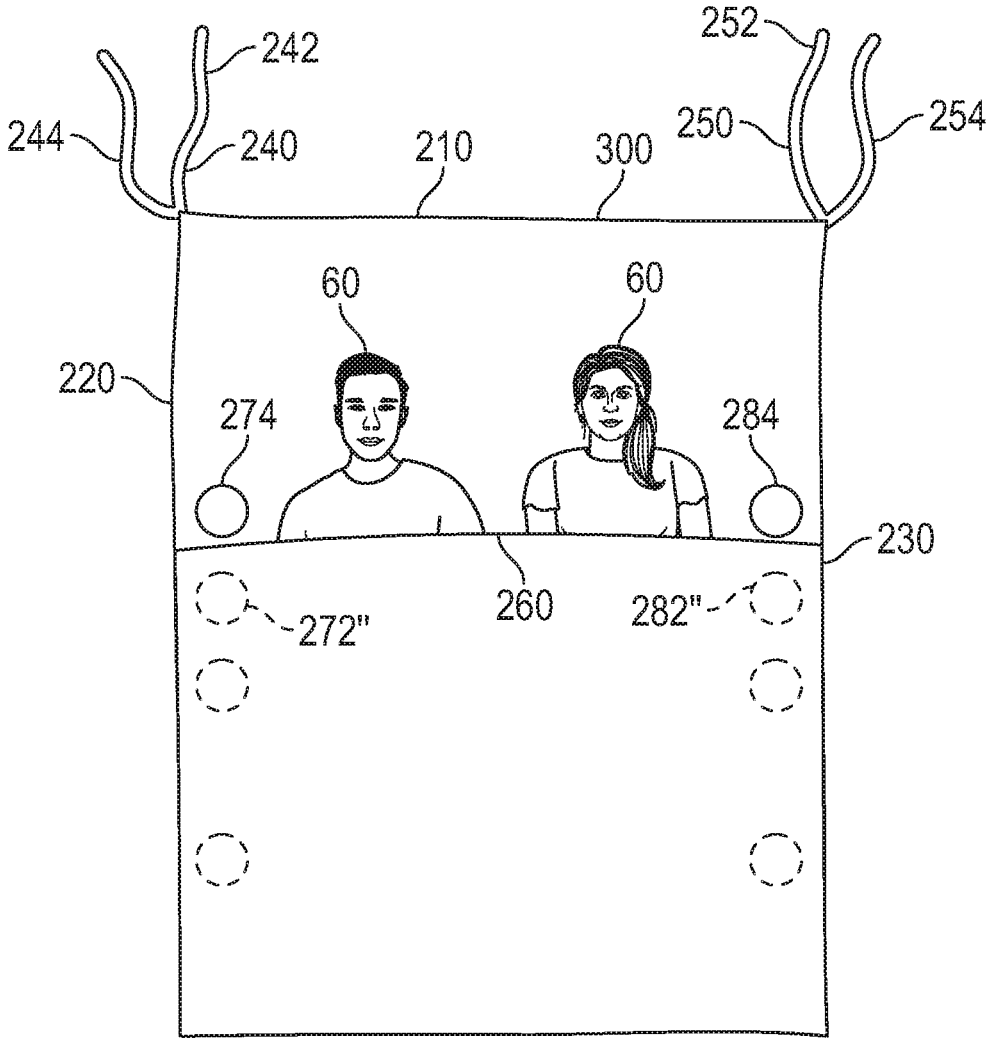
FIG. 14 is a front elevational view of the blanket of FIG. 12 with two users using the blanket as a sleeping bag.

Still optionally, another first left connector portion 272" is provided between left slit 310 and front edge 260 proximate to front edge 260. Similarly, another first right connector portion 282" is provided between right slit 320 and front edge 260 proximate to right edge 260. In this embodiment, with blanket 300 on a floor, front edge 260 can be brought up to second left and right connector portions 274, 284 so that first left and right connector portions 272", 282" can be connected to second left and right connector portions 274, 284 and blanket 300 can be used as a sleeping bag, as shown in FIG. 14.

Figure 15:
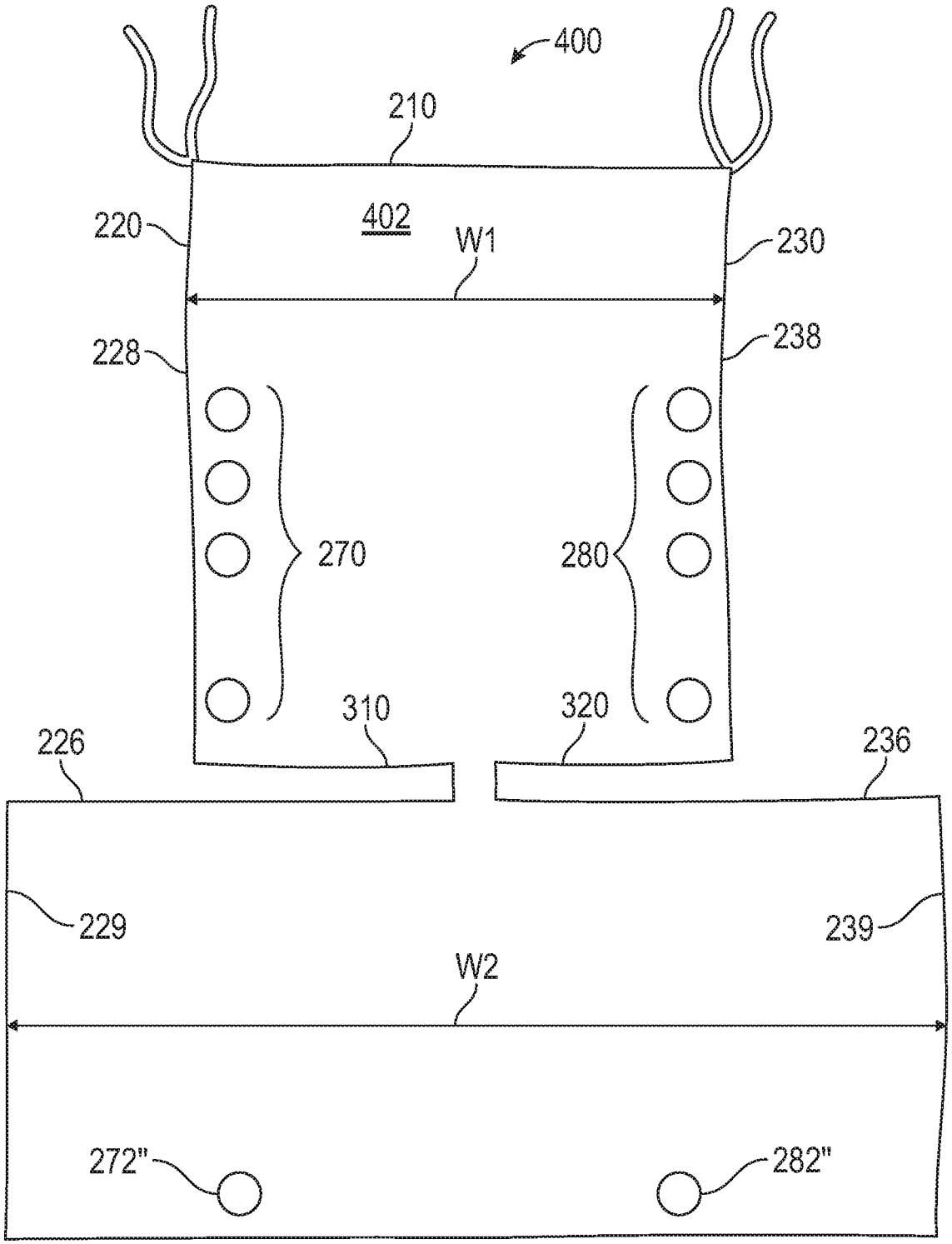
FIG. 15 is a front elevational view of an alternative embodiment of a blanket according to the present invention.

An alternative embodiment of a couch blanket 400 is shown in FIG. 15. Blanket 400 is similar to blanket 300 but has a body 402 that includes a first width W1 between an upper left edge portion 228 and an upper right edge portion 238 above slits 310, 320 and a second width W2 between the edge 220 and right edge 230, larger than the first width W1, between a lower left edge portion 229 and a lower right edge portion 239 below slits 310, 320.

The wider feature can accommodate taller users 60 when used in the configuration shown in FIGS. 10 and 11, or wider couches 50 when used in the configuration shown in FIG. 13.

It will be further understood that various changes in the details, materials, and arrangements of the parts which have been described and illustrated in order to explain the nature of this invention may be made by those skilled in the art without departing from the scope of the invention as expressed in the following claims.

I claim:

1. A couch blanket comprising; a rear edge having first and second corners, wherein a first connector strap assembly extends from the first corner and a second connector strap assembly extends from the second corner, the first connector strap assembly and the second connector strap assembly for connecting to the couch; a left edge extending from the rear edge proximate to the first connector strap assembly, the left edge having a left length; a right edge extending from the rear edge proximate to the second connector strap assembly, the right edge having a right length; a central longitudinal axis extending between the left edge and the right edge; a slit extending from the left edge and toward the central longitudinal axis for inserting the legs of a person through; a front edge connecting the left edge and the right edge, distal from the rear edge; a first plurality of connectors extending along the left edge, the first plurality of connectors having a first left connector portion below the slit and a plurality of second left connector portions above the slit, such that the first left connector portion is configured to engage one of the second left connector portions such that, when the first left connector portion is engaged with one of the second left connector portions, the left length is shortened; and a second plurality of connectors extending along the right edge, the second plurality of connectors having a first right connector portion below the slit and a plurality of second right connector portions above the slit, such that the first right connector portion is configured to engage one of the second right connector portions such that, when the first right connector portion is engaged with one of the second right connector portions, the right length is shortened.

2. The couch blanket according to claim 1, further comprising a right slit extending from the right edge toward the left edge.

3. The couch blanket according to claim 2, wherein the left slit and the right slit extend co-linearly.

4. The couch blanket according to claim 1, further comprising an additional first left connector portion.

5. The couch blanket according to claim 1, wherein the left slit comprises a zipper.

6. A couch blanket comprising: a body having: a rear edge; a front edge; a left edge extending between the rear edge and the front edge; and a right edge, distal from the left edge, the right edge extending between the rear edge and the front edge; a slit extending from one of the left edge and the right edge toward the other of the left edge and the right edge for inserting the legs of a person through; a first plurality of connectors extending along the left edge, the first plurality of connectors having a first left connector portion below the slit and a plurality of second left connector portions above the slit, such that the first left connector portion is configured to engage one of the second left connector portions such that, when the first left connector portion is engaged with one of the second left connector portions, a distance between the front edge and the rear edge is shortened; and a second plurality of connectors extending along the right edge, the second plurality of connectors having a first right connector portion below the slit and a plurality of second right connector portions above the slit, such that the first right connector portion is configured to engage one of the second right connector portions such that, when the first right connector portion is engaged with one of the second right connector portions a distance between the front edge and the rear edge is shortened.

7. The couch blanket according to claim 6, further comprising:

a first connector strap assembly extending from an intersection of the rear edge and the left edge; and a second connector strap assembly extending from an intersection of the rear edge and the right edge.

8. The couch blanket according to claim 6, further comprising a left slit extending below the first plurality of connectors from the left edge toward the right edge.

9. The couch blanket according to claim 8, wherein the left slit comprises a left zipper.

10. The couch blanket according to claim 9, further comprising a right slit extending below the second plurality of connectors from the right edge toward the left edge, such that the left slit and the right slit extend co-linearly.

11. The couch blanket according to claim 10, wherein the body extends between the left slit and the right slit.

12. The couch blanket according to claim 6, further comprising another first left connector portion proximate to the front edge.

13. A couch blanket comprising: a generally rectangular body having: a front side; an underside; a rear edge; a front edge; a side edge extending between the rear edge and the front edge; a zippered slit extending from the side edge and into the body for inserting the legs of a person through, the zippered slit operable by a zipper; and a first plurality of connectors extending along the side edge, the first plurality of connectors having a first connector portion on the front side below the zippered slit a rear connector portion on the underside below the zippered sift, and at least one second connector portion on the front side above the zippered slit, such that each of the first connector portion and the rear connector portion is configured to directly engage the second connector portion wherein, when the first connector portion is engaged with the second connector portion, a distance between the front edge and the rear edge is shortened and wherein, when the zippered slit is open and the rear connector portion is engaged with the second connector portion, the body is secured with a gap between the rear connector portion and the zipper.

* * * * *